US006811528B1

(12) United States Patent
Chen

(10) Patent No.: US 6,811,528 B1
(45) Date of Patent: Nov. 2, 2004

(54) MACHINE FOR INSTALLING A ZIPPER SLIDER TO A ZIPPER BAG

(76) Inventor: Chun-Shan Chen, P.O. Box 90, Tainan City (TW)

( * ) Notice: Subject to any disclaimer, the term of this patent is extended or adjusted under 35 U.S.C. 154(b) by 0 days.

(21) Appl. No.: 10/777,617

(22) Filed: Feb. 9, 2004

(51) Int. Cl.[7] ..... B31B 1/90

(52) U.S. Cl. ..... 493/212; 493/927; 53/133.3; 53/139.2

(58) Field of Search ..... 493/212–214, 493/927; 53/133.3, 133.4, 139.2; 29/408, 409, 768; 74/527, 531

(56) References Cited

U.S. PATENT DOCUMENTS 5,010,627 A * 4/1991 Herrington et al. ..... 24/400
6,178,722 B1 * 1/2001 McMahon ..... 53/412
6,292,986 B1 * 9/2001 Provan et al. ..... 24/415
6,442,819 B1 * 9/2002 Kettner ..... 29/408
6,490,769 B2 * 12/2002 Siegel ..... 24/415
6,508,969 B1 * 1/2003 Kolovich et al. ..... 264/252
6,517,473 B1 * 2/2003 Cappel ..... 493/213
6,526,726 B1 * 3/2003 Strand et al. ..... 53/412
6,584,666 B1 * 7/2003 Savicki ..... 29/408

* cited by examiner

*Primary Examiner*—Eugene Kim
*Assistant Examiner*—Hemant M. Desai

(57) ABSTRACT

A machine for installing a zipper slider to a plastic zipper bag comprises a vibrating device, a zipper slider feed, an aligning tower, an urging device, an injecting device and a pressing device. The machine automatically couples zipper sliders with zipper bags in large amounts while taking little time, thereby significantly enhancing production efficiency.

1 Claim, 11 Drawing Sheets

MACHINE FOR INSTALLING A ZIPPER SLIDER TO A ZIPPER BAG

BACKGROUND OF THE INVENTION

1. Field of the Invention

The present invention relates to devices installing zipper sliders to zipper bags, more particularly to a machine for installing a zipper slider to a zipper bag comprising a vibrating device, a zipper slider feed, an aligning tower, an urging device, an injecting device and a pressing device. The machine automatically couples zipper sliders with zipper bags in large amounts while taking little time, thereby significantly enhancing production efficiency.

2. Description of the Prior Art

The conventional method to install a zipper slider 92 to a zipper bag 9, as shown in FIG. 1, is to first leave a lateral side of the zipper bag 9 unsealed. A zipper slider 92 is placed at the corner where the zipper rail 91 and the unsealed side intersect. The opening of the zipper slider 92 is then aligned and coupled with the zipper rail 91. The unsealed side is then sealed to complete manufacturing process of the zipper bag 9. The process is time-consuming and requires a high level of manual operation, and the production cost is therefore high.

SUMMARY OF THE INVENTION

The primary objective of the present invention is to provide a machine for installing a zipper slider to a zipper bag by which zipper sliders can be automatically coupled with zipper bags in large amounts while taking little time, thereby significantly minimizing labor cost and enhancing production efficiency.

To achieve above object, the present invention provides a machine for installing a zipper slider to a zipper bag, comprising: a vibrating device having a disk vibrator, the disk vibrator being provided with a spiral rail on an inner wall thereof for guiding zipper sliders out of the disk vibrator, the spiral rail having an outlet at one terminal thereof, the disk vibrator further including a sifting board near the outlet for selecting zipper sliders of proper size; a zipper slider feed having a first end connected to vibrating device in a substantially tangent direction for guiding zipper sliders ejected from the vibrating device; an aligning tower connected to a second end of the zipper slider feed for aligning zipper sliders transported from the zipper slider feed; an urging device connected to a lower end of the aligning tower for urging zipper sliders to move in a substantially horizontal direction one at a time; an injecting device connected to one side of the urging device for temporarily enlarging an engaging opening of a zipper slider so that the zipper slider can engage with an open side of a zipper bag; and a pressing device connected to one side of the injecting device for holding the zipper bag so that the zipper slider can be slidably connected to the open side of the zipper bag. The injecting device is a pressure-driven levering system including a gas cylinder, a connecting tube with one end connected to an urging terminal of the gas cylinder, a movable frame connected to another end of the connecting tube, a bracket housing the connecting tube and the movable frame. The connecting tube is provided with a push rod therein and a spring at a rear end of the push rod. The movable frame is supported by a pair of guiding frames respectively against an upper surface and a lower surface thereof and is connected to a positioning head at a front end thereof. The positioning head is pivotally connected to a pair of hook members respectively on an upper surface and a lower surface thereof. The hook members each having a hooked piece at one end and a guiding piece at another end, the guiding pieces each having a projection extending inwardly onto an elastic plate attached on a wall of the movable frame. The movable frame further includes two connecting beams respectively pivot-connected to two guiding beams, the guiding beams being inserted into two opposite walls near the front end of the movable frame. The push rod within the connecting tube is provided with a push head at a front end thereof and extends through a front side of the positioning head, the push head having two lateral sides respectively pivot-connected to the connecting beams, the push head further including two press arms respectively formed on an upper face and a lower face thereof for containing two clipping plates therebetween, the clipping plates thereby forming a receptacle for housing a zipper slider.

DETAILED DESCRIPTION OF THE PREFERRED EMBODIMENTS

The various objects and advantages of the present invention will be more readily understood from the following detailed description when read in conjunction with the appended drawings.

Figure 1:
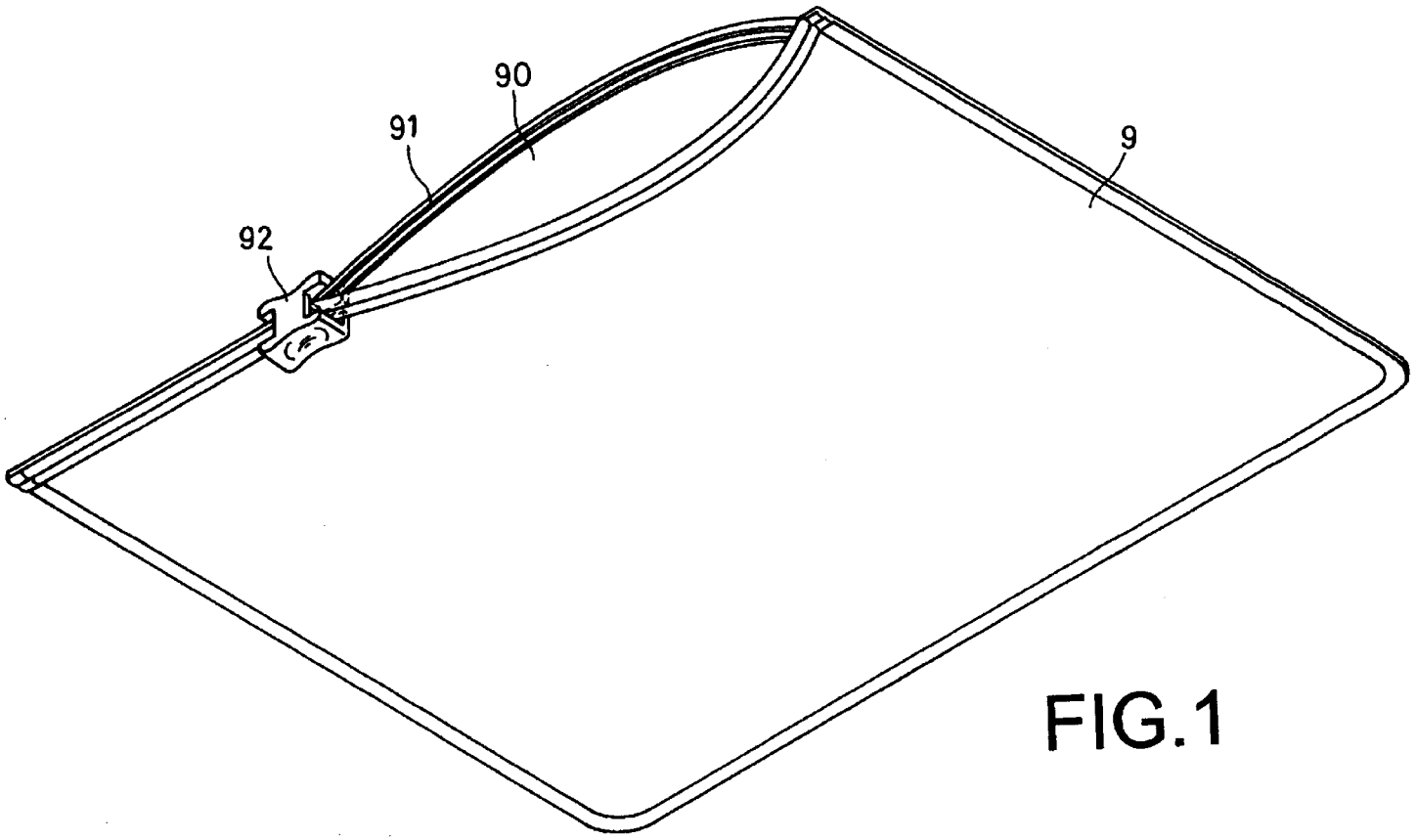
FIG. 1 is a perspective view of a zipper bag.
Figure 2:
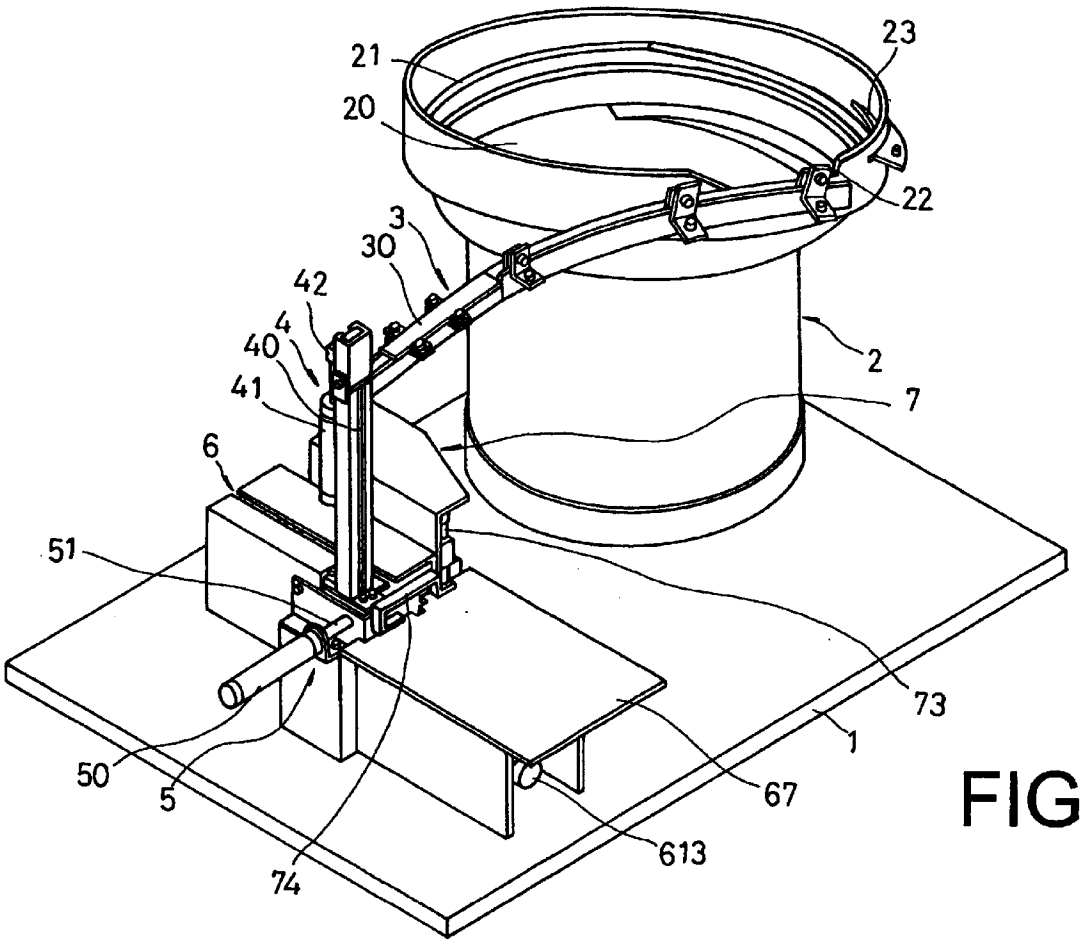
FIG. 2 is a perspective view of a preferred embodiment of the present invention.
Figure 3:
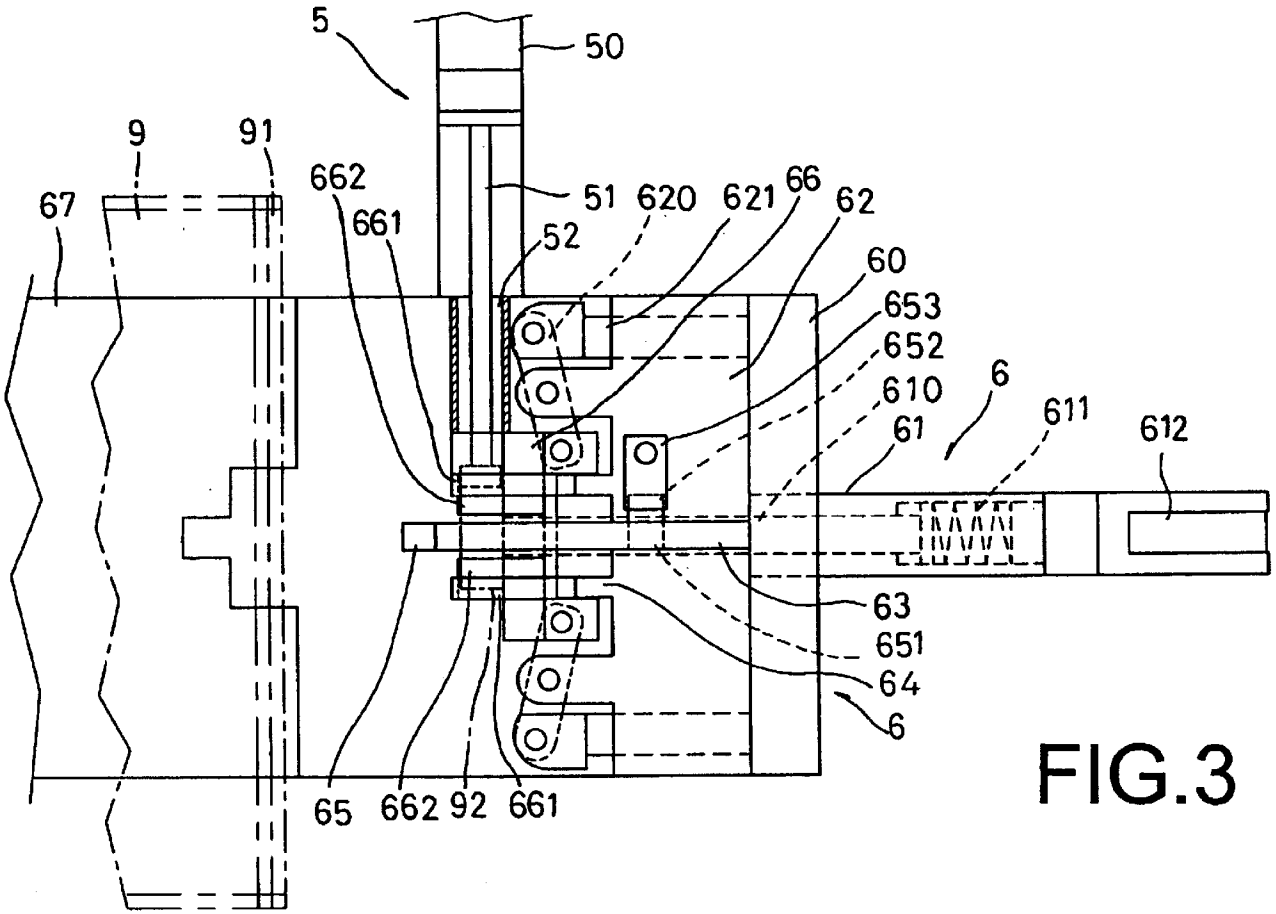
FIG. 3 is a top view of the injecting device of a preferred embodiment according to the present invention.
Figure 4:
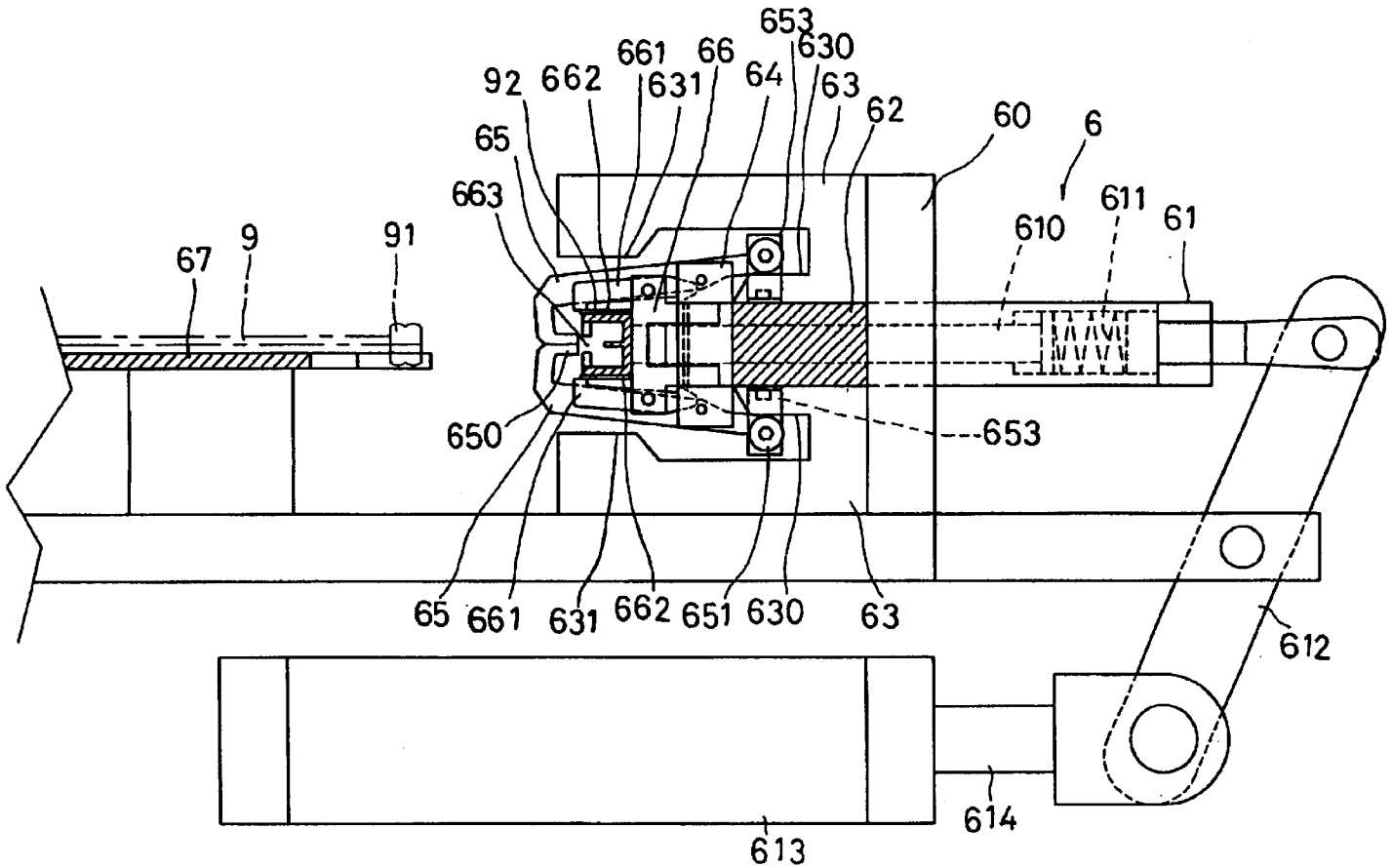
FIG. 4 is a lateral view of the injecting device of a preferred embodiment according to the present invention.
Figure 10:
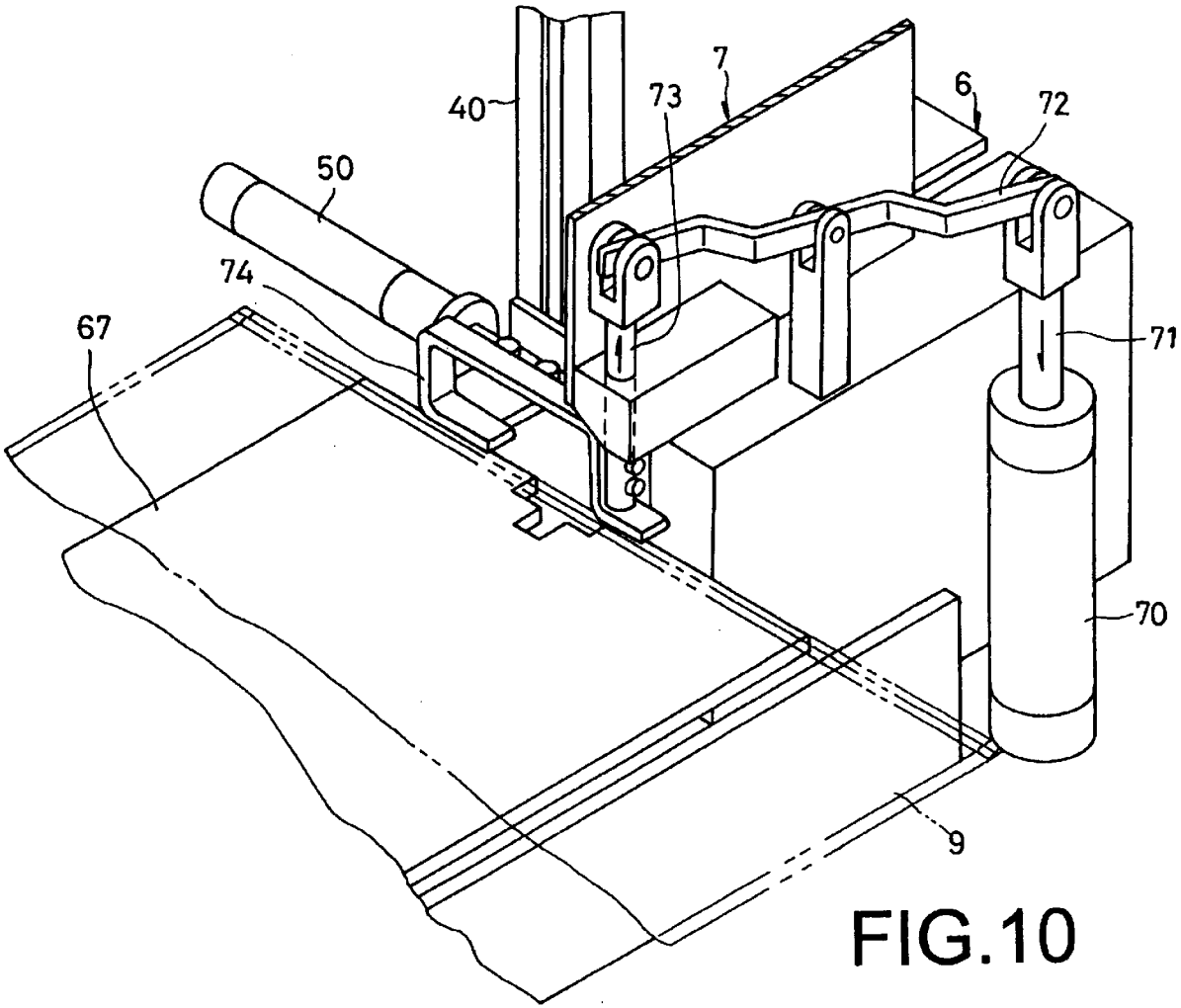
FIG. 10 is a perspective view of the pressing device of a preferred embodiment according to the present invention not being used.

Referring to FIG. 2, a machine for installing a zipper slider to a zipper bag according to the present invention is mounted on a base 1. It comprises a vibrating device 2, a zipper slider feed 3, an aligning tower 4, an urging device 5, an injecting device 6 and a pressing device 7. The vibrating device has a disk vibrator 20 provided with a spiral rail 21 on the inner wall thereof, by which a multitude of zipper sliders 92 can be transported along the spiral rail 21 toward an outlet 22. The disk vibrator 20 further includes a sifting board 23 near the outlet 22 for selecting zipper sliders of proper size. The zipper slider feed 3 is provided with a guiding groove 30, and it has a first end connected to vibrating device 2 in a substantially tangent direction for allowing zipper sliders 92 ejected from the vibrating device 2 to slide along the guiding groove 30. The aligning tower 4 is connected to a second end of the zipper slider feed 3 for aligning a plurality of zipper sliders 92 from the zipper slider feed3. The aligning tower 4 is provided with a substantially vertical aligning channel 40. A gas cylinder 41 is disposed adjacent to the aligning channel 40 in a parallel direction for actuating a pressing piece 42 at the top end of the aligning channel 40. The pressing piece 42 pushes the zipper sliders 92 fed into the aligning channel 40 so as to align they in order. The urging device 5 is connected to the lower end of the aligning tower 4 for urging zipper sliders 92 to move in a substantially horizontal direction one at a time. The urging device 5 is provided with a gas cylinder 50. A push rod 51 is disposed in front of the gas cylinder 50 so that the push rod 51 can be driven to move about an inlet 52. Referring to FIGS. 3 and 4, an injecting device 6 is connected to one side of the urging device 5 for temporarily enlarging the engaging opening of a zipper slider 92 so that the zipper slider can engage with the zipper rail 91 a zipper bag 9. The injecting device 6 comprises a bracket 60, a connecting tube 61 going through the bracket 60, a push rod 610 hidden with in the connecting tube 61, a movable frame 62 connected to the front end of the connecting tube 61 and a spring 611 attached to the rear end of the push rod 610. The rear end of the connecting tube 61 is pivotally connected to a link 612, and the other end of the link 612 is connected to a push rod 614 slidably connected to a gas cylinder 613. A pair of guiding frames 63 respectively support against an upper surface and a lower surface of the movable frame 62. Each of the guiding frames 62 is provided with a first flange 630 and a second flange 631. The front end of the movable frame 62 is connected to a positioning head 64. The positioning head 64 is pivotally connected to a pair of hook members 65 respectively on an upper surface and a lower surface thereof. Each of the hook members 65 has a hooked piece 650 at one end and a guiding piece 651 at another end. Each of the guiding pieces 651 has a projection 652 extending inwardly onto an elastic plate 653 attached to the movable frame 62. The movable frame 62 further includes two connecting beams 620 respectively pivotally connecting two guiding beams 621. The guiding beams 621 are respectively inserted into two opposite walls near the front end of the movable frame 62. The push rod 610 within the connecting tube 61 is provided with a push head 66 at the front end thereof and extends through the front side of said positioning head 64. The push head 66 has two lateral sides respectively pivot-connected to the connecting beams 620. The push head 66 further includes two press arms 661 respectively formed on an upper face and a lower face thereof for containing two clipping plates 662 therebetween. The clipping plates 662 thereby form a receptacle 663 for housing a zipper slider 92. In front of the injecting device 6 there is a platform 67 for placing a zipper bag 9. A pressing device 7 is connected to one side of the injecting device 6 for holding the zipper bag 9 so that a zipper slider 92 can be slidably engaged with the zipper rail 91 of said zipper bag 9. Referring to FIG. 10, the pressing device 7 comprises a gas cylinder 70 having an uprightly extending push rod 71. The push rod 71 is connected to one end of a level 72. The level 72 has another end pivotally connected to a press rod 73. A press head 74 disposed at the lower end of the press rod 73 can press a zipper bag 91 against the platform 67.

Figure 5:
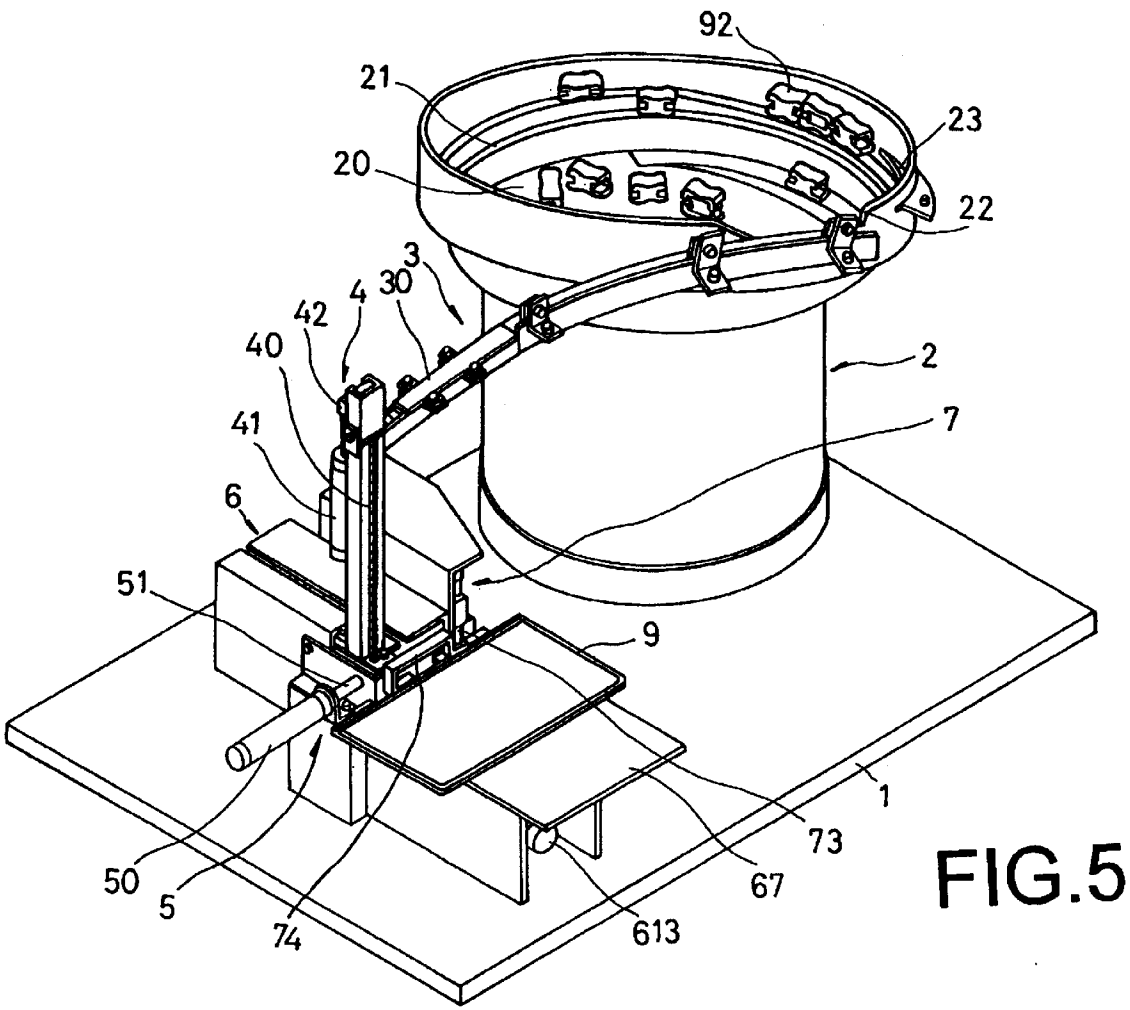
FIG. 5 is another perspective view of a preferred embodiment of the present invention showing zipper sliders being transported therein.
Figure 6:
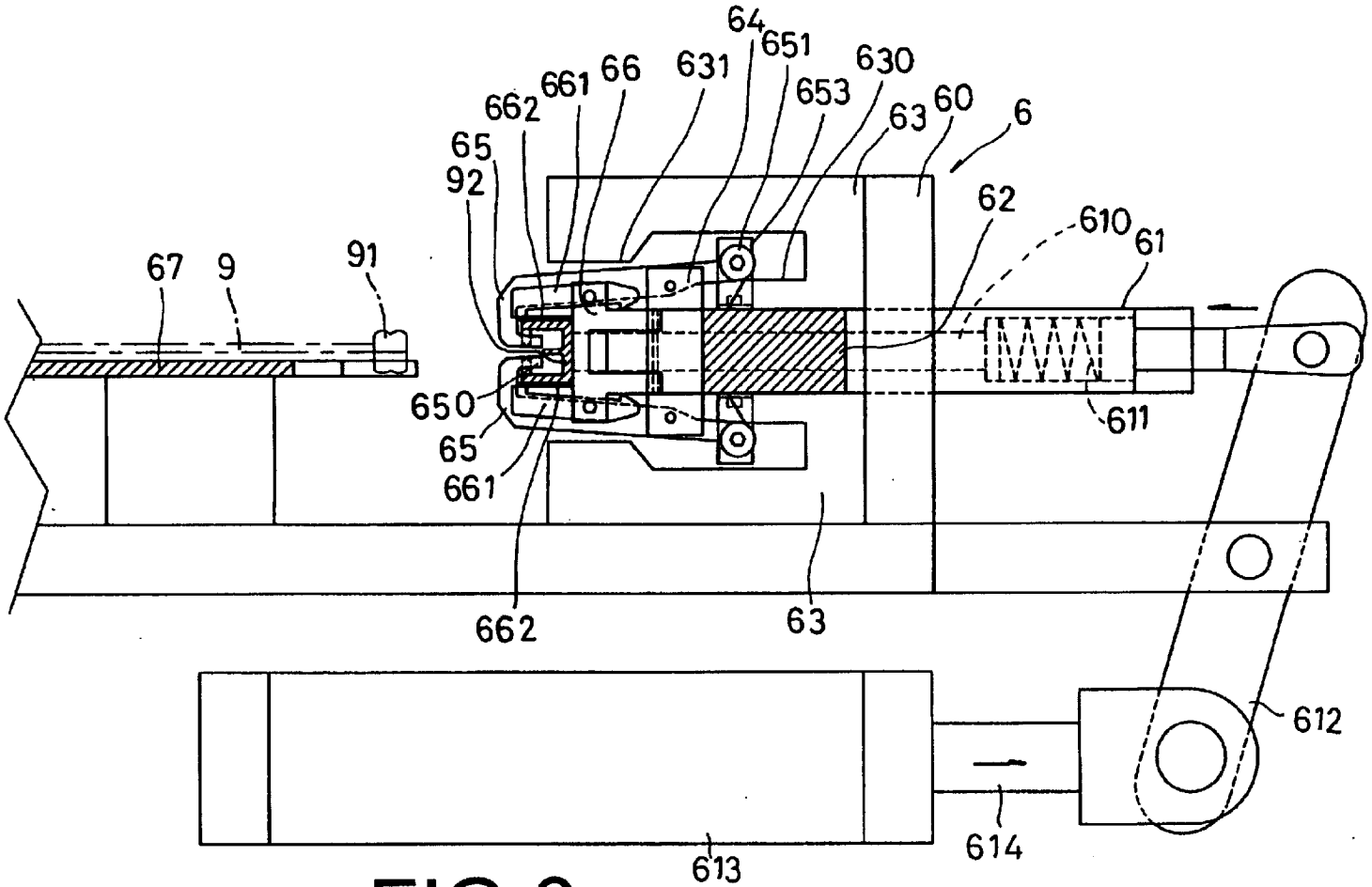
FIG. 6 is a lateral view of the injecting device of a preferred embodiment according to the present invention in which the connecting tube is slightly moving forward.
Figure 7:
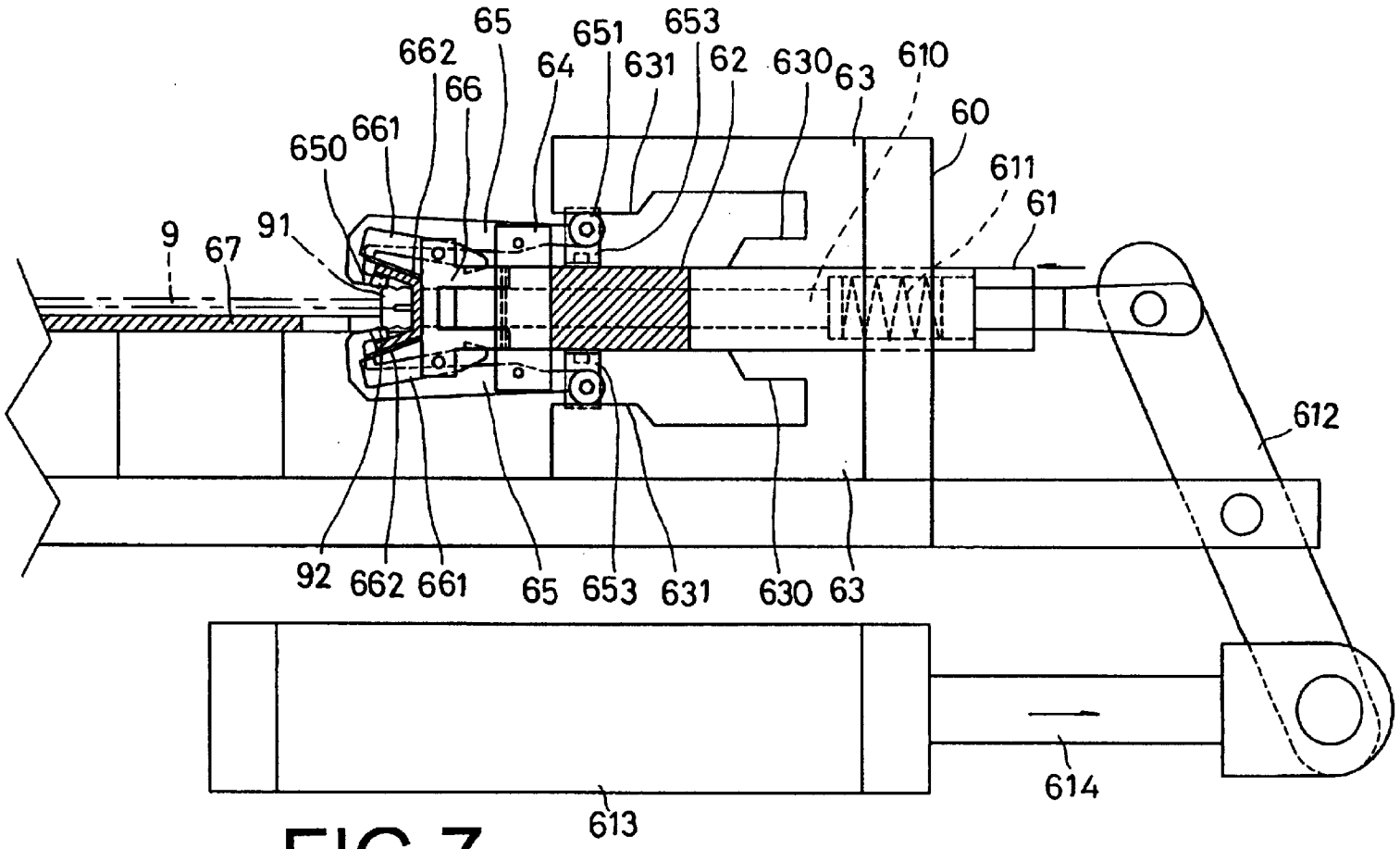
FIG. 7 is a lateral view of the injecting device of a preferred embodiment according to the present invention in which the connecting tube is moved into the outmost position.
Figure 8:
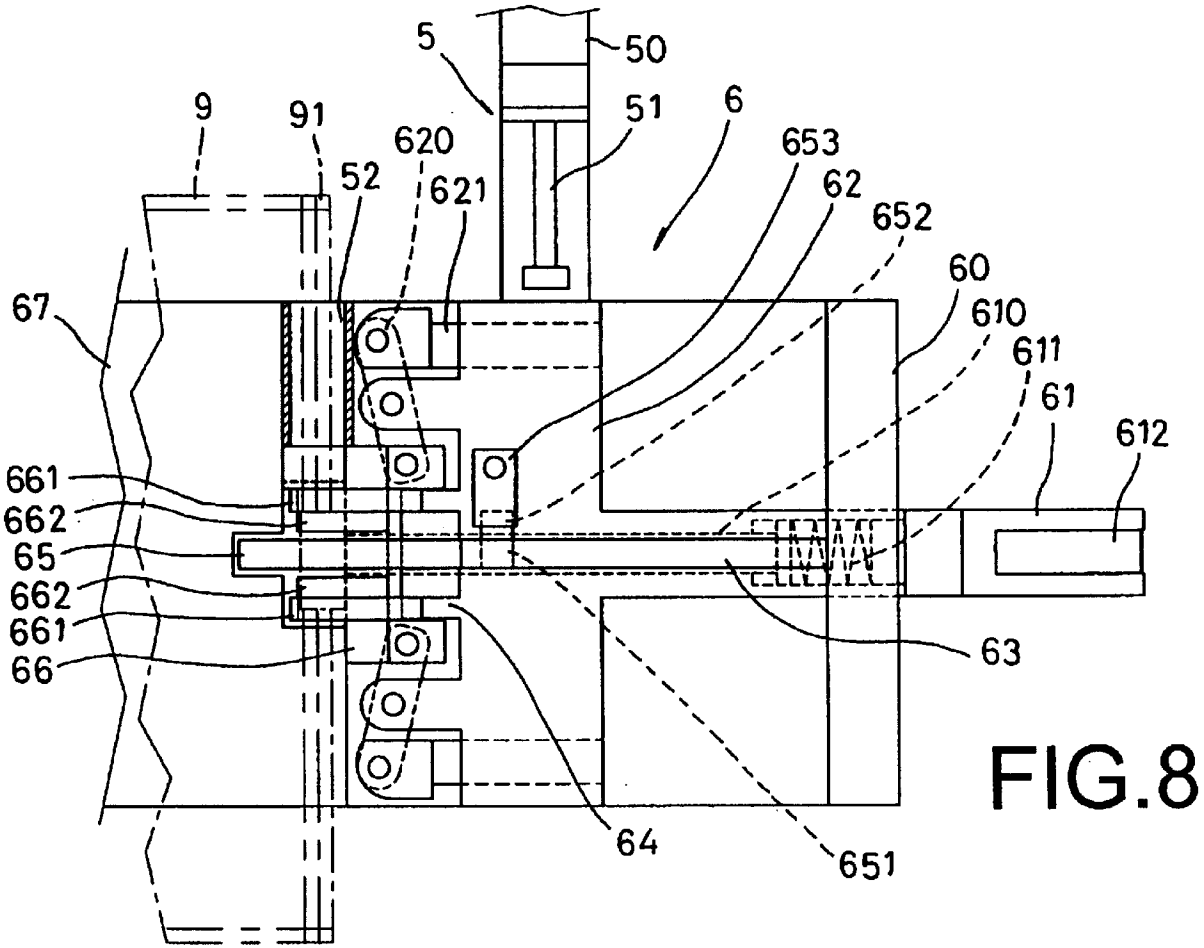
FIG. 8 is a top view of the injecting device of a preferred embodiment according to the present invention in which the hook members spread wide to extend the engaging opening of a zipper slider.
Figure 9:
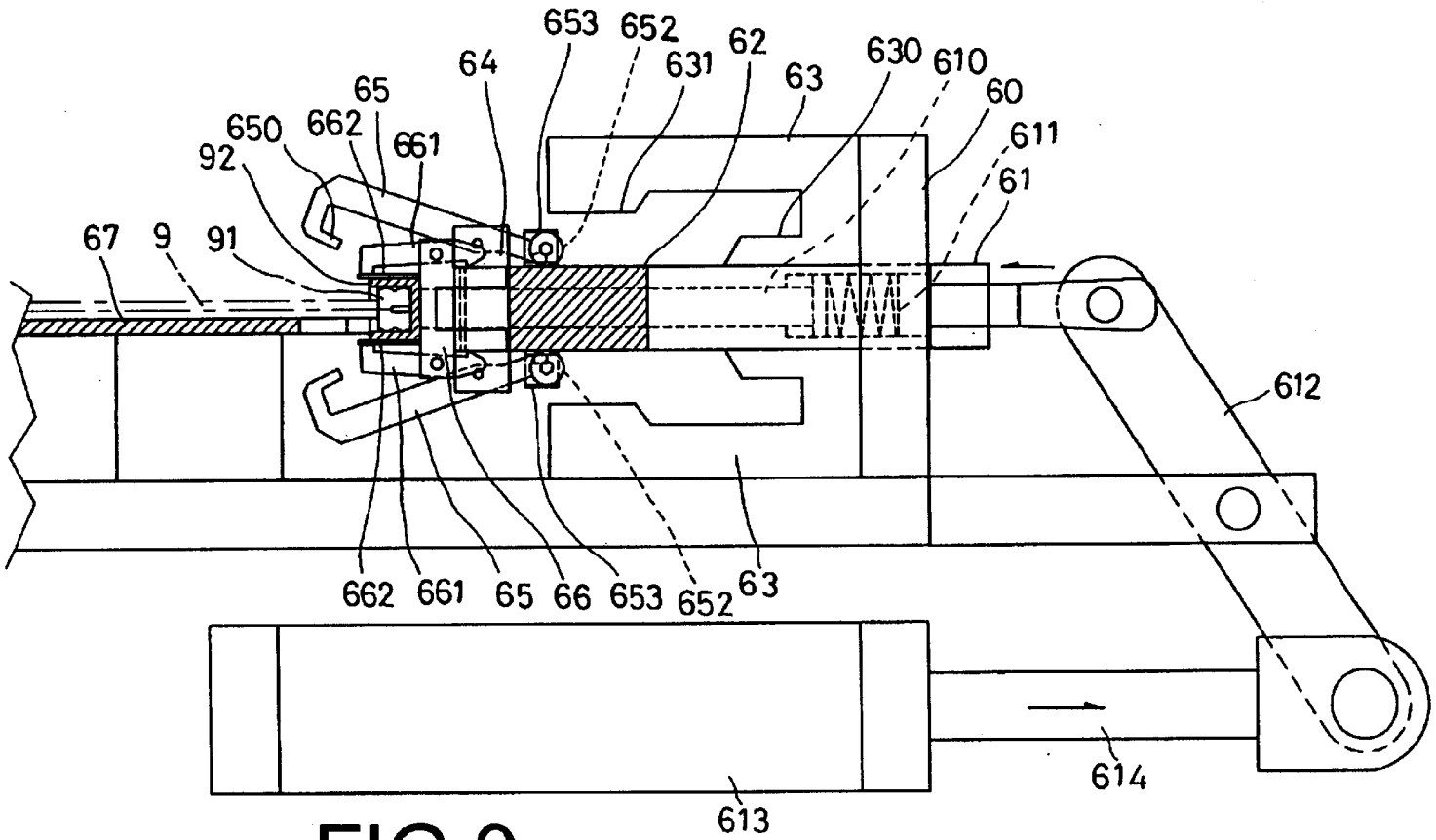
FIG. 9 is a lateral view of the injecting device of a preferred embodiment according to the present invention in which the hook members depart from the zipper slider they firstly held.

FIG. 5 shows the use of the machine for installing a zipper slider to a zipper bag. A multitude of zipper sliders 92 are placed into the disk vibrator 20 of the vibrating device 2. A zipper bag 9 with a sealed circumference is then placed on the platform 67. As the power is on, the disk vibrator 20 of the vibrating device 2 start to vibrate, and the zipper sliders 92 in the disk vibrator 20 will accordingly move along the spiral rail 21 on the inner wall of the disk vibrator 20. As the moving zipper sliders 92 arrives the outlet 22, a sifting board 23 will remove zipper sliders 92 that do not have their engaging opening facing the outlet 22. Those zipper sliders 92 do not pass will be dropped to the bottom of the disk vibrator 20 and start all over again. The zipper sliders 92 that pass the outlet 22 are pushed into a guiding groove 30 of a zipper slider feed 3. The guiding groove 30 transports the zipper sliders 92 therein to the aligning channel 40 of the aligning tower 4 and then get pressed by the pressing piece 42 of the aligning tower 4 as driven by the gas cylinder 41, so that the lowest zipper slider 92 falls into the inlet 52 of the urging device 5. Referring to FIGS. 3 and 4, the gas cylinder 50 of the urging device 5 urges the push rod 51 so as to push the zipper slider 92 into the receptacle 663 of the injecting device 6. Referring to FIG. 6, the zipper slider 92 is sandwiched by the upper and lower clipping plates 662. The gas cylinder 613 urges a push rod 614 to extend so as to drive a link 612. The connecting tube 61 moves forward accordingly, causing the spring 611 behind the push rod 610 to slightly bounce the push rod 610 and the push head 66 to move forward. The push head 66 urges the zipper slider 92 in the receptacle 663 slightly forward so that the hooked pieces 650 of the hook members 65 get locked with the opening of the zipper slider 92. As the push rod 61 continues to move, the guiding pieces 651 will eventually depart from the first flanges 630 of the guiding frames 63 and will be pressed by the second flanges 631 of the guiding frames 63, as shown in FIG. 7. As a result, the hooked pieces 650 of the hook members 65 will spread outwardly so as to enlarge the opening of the zipper slider 92, and thereby the zipper slider 92 can be engaged with the opening 90 of the zipper bag 9. Referring to FIGS. 9 and 10, as the connecting tube 61 continues to move, the push head 66 will be stopped by the platform 67. The movable frame 62 continues to move with the connecting tube 61, thereby the push head 66 contracting the spring 611. The hook members 65 going with the movable frame 62 will fall off the opening of the zipper slider 92. Since the projections 652 at the rear ends of the hook members 65 are pressed by the elastic plates 653, the hooked pieces 650 maintain a spread configuration as the hook members bounces back so that the zipper slider 92 will not be hindered. At the same time when the hooked pieces 650 retreat, the press arms 661 of the push head 66 respectively support against the upper and lower walls of the positioning head 64, causing the press arms 661 to pinch toward the receptacle 663 and on the clipping plates 662. The clipping plates 662 thereby pinch the opening the zipper slider 92 to restore its original shape. The installation of a zipper slider 92 to a zipper bag 9 is thus completed. The gas cylinder 613 now actuates to retreat the push rod 614 and pull back the connecting tube 61, and then the movable frame 62 and the associated components recover their initial positions.

Figure 11:
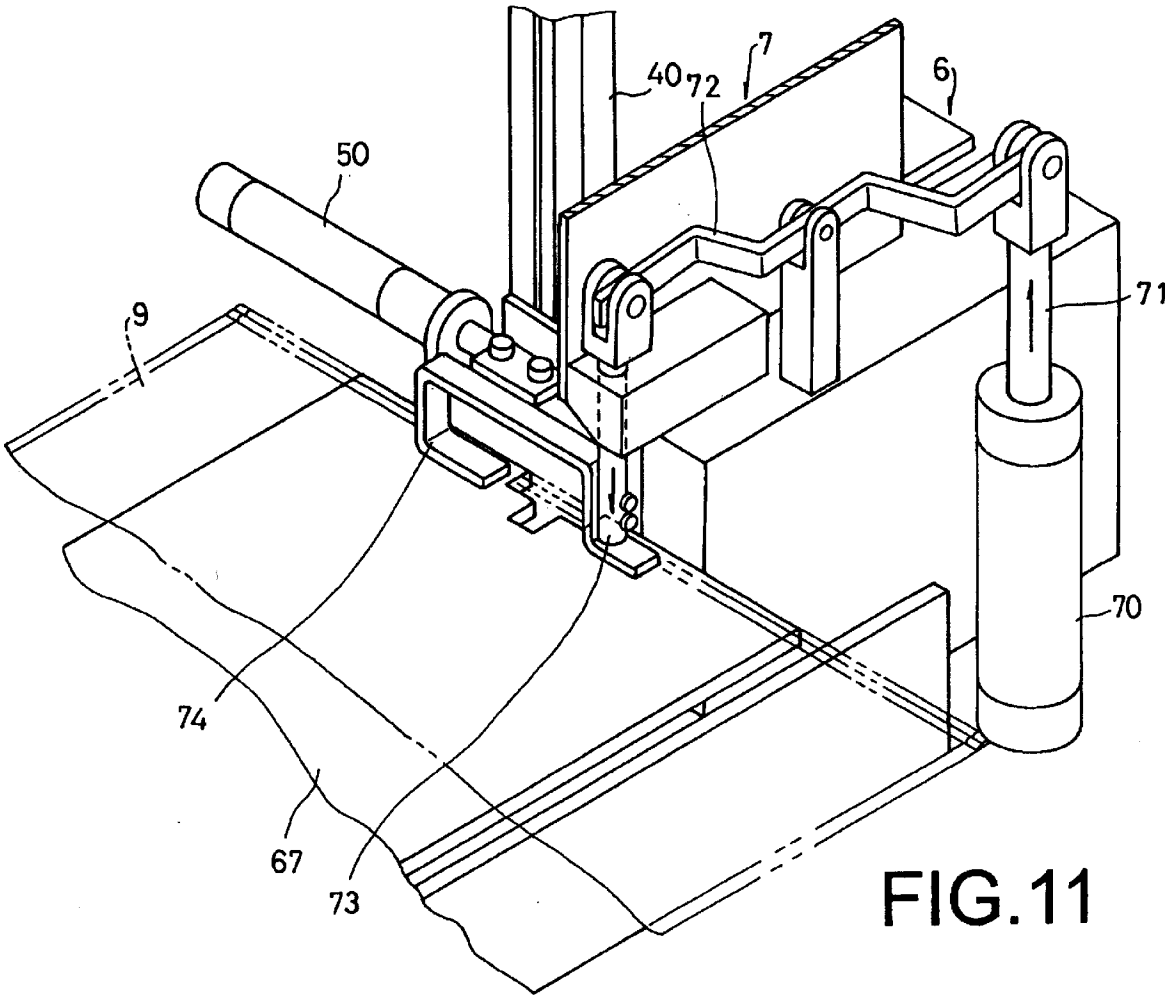
FIG. 11 is a perspective view of the pressing device of a preferred embodiment according to the present invention holding a zipper bag.

As shown in FIG. 11, the gas cylinder 70 pushes the push rod 71 to move upwardly so that one end of the level 72 ascends and the other end of the level 72 descends, forcing the press rod 73 to move downward. The press head 74 punches a zipper bag 9 on the platform 67 for receiving a zipper slider 92. The pressing device 7 described above can move in a reverse direction to release a zipper bag 9, as shown in FIG. 10. Therefore, the machine for installing a zipper slider to a zipper bag can automatically install zipper sliders to zipper bags in large amounts while taking little time, thereby significantly minimizing labor cost and enhancing production efficiency.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A machine for installing a zipper slider to a zipper bag, comprising:

a vibrating device having a disk vibrator, said disk vibrator being provided with a spiral rail on an inner wall thereof for guiding zipper sliders out of said disk vibrator, said spiral rail having an outlet at one terminal thereof, said disk vibrator further including a sifting board near said outlet for selecting zipper sliders of proper size;

a zipper slider feed having a first end connected to vibrating device in a substantially tangent direction for guiding zipper sliders ejected from said vibrating device;

an aligning tower connected to a second end of said zipper slider feed for aligning zipper sliders transported from said zipper slider feed;

an urging device connected to a lower end of said aligning tower for urging zipper sliders to move in a substantially horizontal direction one at a time;

an injecting device connected to one side of said urging device for temporarily enlarging an engaging opening of a zipper slider so that said zipper slider can engage with an open side of a zipper bag; and, a pressing device connected to one side of said injecting device for holding said zipper bag so that said zipper slider can be slidably connected to said open side of said zipper bag;

wherein said injecting device is a pressure-driven levering system including a gas cylinder, a connecting tube with one end connected to an urging terminal of said gas cylinder, a movable frame connected to another end of said connecting tube, a bracket housing said connecting tube and said movable frame; said connecting tube is provided with a push rod therein and a spring at a rear end of said push rod; said movable frame is supported by a pair of guiding frames respectively against an upper surface and a lower surface thereof and is connected to a positioning head at a front end thereof; said positioning head is pivotally connected to a pair of hook members respectively on an upper surface and a lower surface thereof, said hook members each having a hooked piece at one end and a guiding piece at another end, said guiding pieces each having a projection extending inwardly onto an elastic plate attached on a wall of said movable frame; said movable frame further includes two connecting beams respectively pivot-connected to two guiding beams, said guiding beams being inserted into two opposite walls near said front end of said movable frame; said push rod within said connecting tube is provided with a push head at a front end thereof and extends through a front side of said positioning head, said push head having two lateral sides respectively pivot-connected to said connecting beams, said push head further including two press arms respectively formed on an upper face and a lower face thereof for containing two clipping plates therebetween, said clipping plates thereby forming a receptacle for housing a zipper slider.

* * * * *